US012371297B2

(12) United States Patent
Suzuki

(10) Patent No.: US 12,371,297 B2
(45) Date of Patent: Jul. 29, 2025

(54) TAPE AFFIXING APPARATUS

(71) Applicant: DISCO CORPORATION, Tokyo (JP)

(72) Inventor: Kunishige Suzuki, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 212 days.

(21) Appl. No.: 18/325,320

(22) Filed: May 30, 2023

(65) Prior Publication Data

US 2023/0391576 A1 Dec. 7, 2023

(30) Foreign Application Priority Data

Jun. 6, 2022 (JP) ..... 2022-091454

(51) Int. Cl.
*B65H 43/04* (2006.01)
*B65H 37/04* (2006.01)

(52) U.S. Cl.
CPC ..... *B65H 43/04* (2013.01); *B65H 37/04* (2013.01); *B65H 2553/30* (2013.01); *B65H 2553/40* (2013.01)

(58) Field of Classification Search
CPC .... B65H 43/04; B65H 37/04; B65H 2553/30; B65H 2553/40
See application file for complete search history.

(56) References Cited

U.S. PATENT DOCUMENTS

2020/0090976 A1* 3/2020 Wada ..... H01L 21/67132

FOREIGN PATENT DOCUMENTS

| | | | |
|---|---|---|---|
| JP | 2017163091 A | * | 9/2017 |
| JP | 3220069 U | | 1/2019 |
| JP | 2020047699 A | | 3/2020 |
| JP | 2020068269 A | * | 4/2020 |
| JP | 2021048378 A | * | 3/2021 |

OTHER PUBLICATIONS

Office Action issued in counterpart German patent application No. 10 2023 205 029.3, dated Nov. 19, 2024.

* cited by examiner

*Primary Examiner* — George R Koch
(74) *Attorney, Agent, or Firm* — Greer Burns & Crain Ltd.

(57) ABSTRACT

A tape affixing apparatus includes a holding unit that holds a wafer and a ring frame, a peeling plate that peels off a dicing tape from a sheet by bending a tape set at an acute angle, an affixing roller configured to affix the dicing tape to the wafer and the ring frame by pressing the dicing tape peeled off from the sheet by the peeling plate against the wafer and the ring frame, an air nozzle that makes a distal end of the dicing tape peeled off from the sheet conform to an outside surface of the affixing roller, and an end detecting unit that detects the distal end of the dicing tape made to conform to the outside surface of the affixing roller.

8 Claims, 6 Drawing Sheets

TAPE AFFIXING APPARATUS

BACKGROUND OF THE INVENTION

Field of the Invention

The present invention relates to a tape affixing apparatus that affixes a tape to an affixation target object.

Description of the Related Art

A tape affixing apparatus in the past, for example, grinds, by a grindstone, another surface of a wafer having a protective tape affixed to one surface thereof, thereafter integrates a ring frame and the wafer with each other by a dicing tape by affixing the dicing tape to the ring frame and the other surface of the wafer, and then peels off the protective tape from the wafer.

In the tape affixing apparatus that thus affixes the dicing tape to the ring frame and the wafer, a distal end of a tape set including the dicing tape and a sheet is detected in the vicinity of an opening of a case that houses the tape set before the dicing tape is peeled off (see Japanese Patent Laid-Open No. 2020-047699, for example).

In addition, a method of detecting a positional displacement of the dicing tape after being affixed to the ring frame has also been adopted (see, for example, Japanese Utility Model Registration No. 3220069).

SUMMARY OF THE INVENTION

However, in a case where the distal end of the dicing tape peeled off from the sheet is made to conform to an affixing roller, and the affixing roller affixes the dicing tape to the ring frame and the wafer, a distal end position of the dicing tape made to conform to the outside surface of the affixing roller may be displaced due to occurrence of a slip at rollers that feed the tape set or the like. When a slip thus occurs at the rollers that feed the tape set, the distal end position of the dicing tape is thereafter displaced even when the distal end of the tape set is detected in the vicinity of the opening of the case that houses the tape set, as described above. Then, when the distal end position of the dicing tape is displaced, a positional displacement of an affixation position of the tape with respect to an affixation target object occurs, and re-affixation of the dicing tape occurs.

In addition, in a case where a positional displacement of the dicing tape after being affixed to the ring frame is detected as described above, the positional displacement cannot be detected before the affixation, and therefore a dicing tape for re-affixation and a time for the re-affixation become necessary.

It is accordingly an object of the present invention to provide a tape affixing apparatus that can prevent a positional displacement of an affixation position of a tape with respect to an affixation target object.

In accordance with an aspect of the present invention, there is provided a tape affixing apparatus for using a tape set including a tape, the tape having an adhesive layer on one surface of the tape and being cut in a shape corresponding to an affixation target object, and a band-shaped sheet affixed to the adhesive layer, and affixing the tape to the affixation target object while peeling off the tape from the sheet, the tape affixing apparatus including a holding unit configured to hold the affixation target object, an affixing unit configured to affix the tape peeled off from the sheet to the affixation target object held by the holding unit, and a horizontal moving mechanism configured to move the holding unit and the affixing unit relative to each other in a horizontal direction, the affixing unit including a first roller set configured to sandwich the tape set by at least two rollers, a second roller set configured to sandwich the sheet by at least two rollers, a peeling plate configured to peel off the tape from the sheet by bending the tape set at an acute angle at a position between the first roller set and the second roller set, an affixing roller configured to affix the tape to the affixation target object by pressing the tape peeled off from the sheet by the peeling plate against the affixation target object, an air nozzle configured to make a distal end of the tape peeled off from the sheet conform to an outside surface of the affixing roller, and an end detecting unit configured to detect the distal end of the tape made to conform to the outside surface of the affixing roller.

The tape affixing apparatus according to the present invention can prevent a positional displacement of the affixation position of the tape with respect to the affixation target object.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Tape affixing apparatuses according to a first and a second embodiment of the present invention will hereinafter be described with reference to the accompanying drawings.

An X-axis direction, a Y-axis direction, and a Z-axis direction depicted in each figure are in perpendicular relation to each other. The X-axis direction and the Y-axis direction are substantially horizontal directions, and the Z-axis direction is an upward-downward direction (vertical direction). In each figure, a side of a double-headed arrow line indicating the X-axis direction which side is provided with a character +X is set as a right direction, and a side thereof provided with a character −X is set as a left direction. A side of a double-headed arrow line indicating the Y-axis direction which side is provided with a character +Y or Y is set as a frontward direction, and a side thereof provided with a character −Y is set as a rearward direction. A side of a double-headed arrow line indicating the Z-axis direction which side is provided with a character +Z is set as an upward direction, and a side thereof provided with a character −Z is set as a downward direction.

Figure 1:
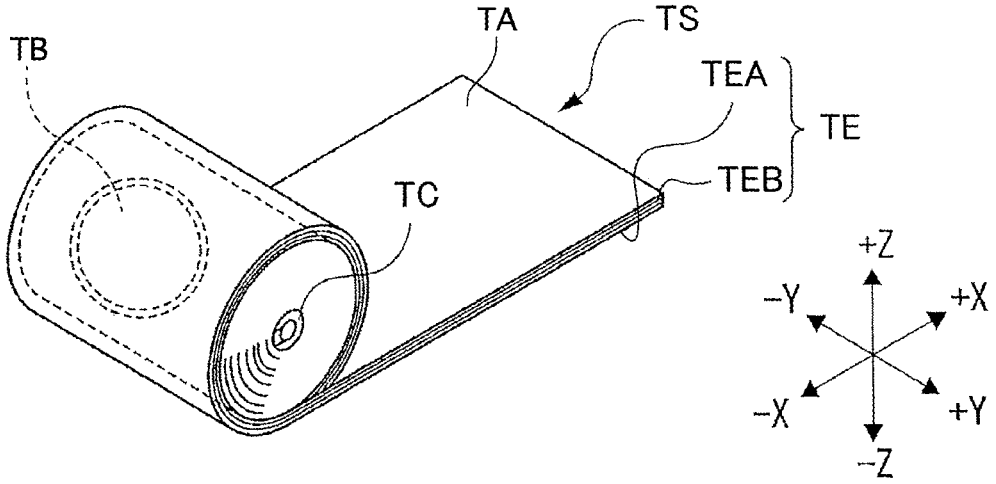
FIG. 1 is a perspective view depicting an example of a tape set wound in a roll shape.

A tape set TS (having a thickness of 200 μm, for example) depicted in FIG. 1 has a structure in which a band-shaped adhesive tape TE and a band-shaped sheet TA are laminated to each other. The adhesive tape TE includes a base material TEA formed of, for example, a polyolefin resin or the like and an adhesive layer TEB on the base material TEA. The sheet TA (having a thickness of 100 μm, for example) is affixed to the adhesive layer TEB side. The adhesive tape TE is precut into a plurality of circular shapes in advance according to the diameter of a ring frame F (see FIG. 2) as an affixation target. A plurality of dicing tapes TB thus formed by the precutting of the adhesive tape TE are affixed to the sheet TA at equal intervals in a longitudinal direction of the sheet TA (X-axis direction in FIG. 1). It is to be noted that materials and the like of the adhesive tape TE and the sheet TA are not particularly limited.

The tape set TS in which the circular dicing tapes TB are arranged and affixed in the longitudinal direction of the band-shaped sheet TA described above is in a state of being wound in a roll shape around a roll tube TC, as depicted in FIG. 1, with the dicing tapes TB on the outside.

First Embodiment

Figure 2:
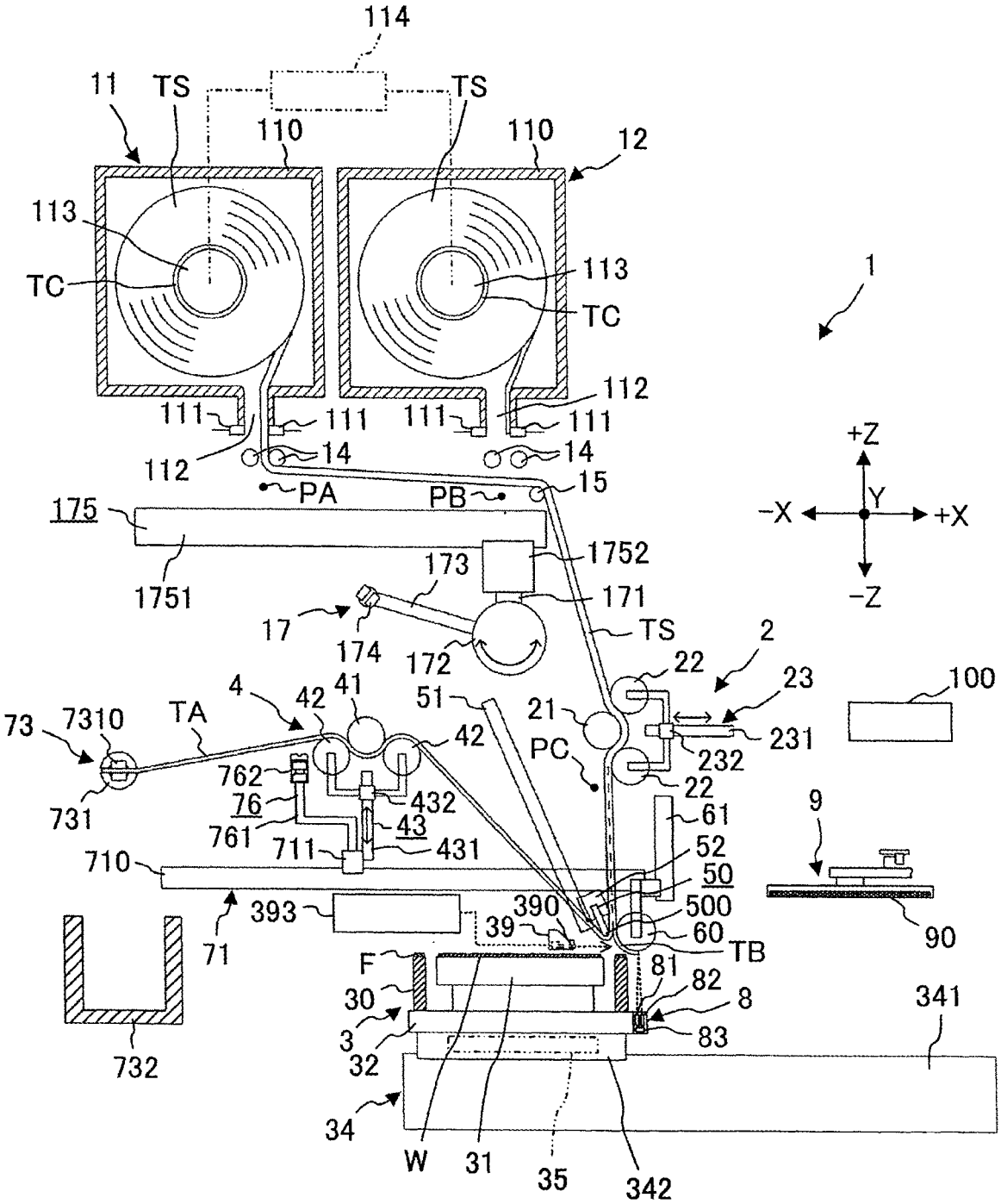
FIG. 2 is a schematic cross-sectional view depicting an example of a configuration of a tape affixing apparatus according to a first embodiment.
Figure 3:
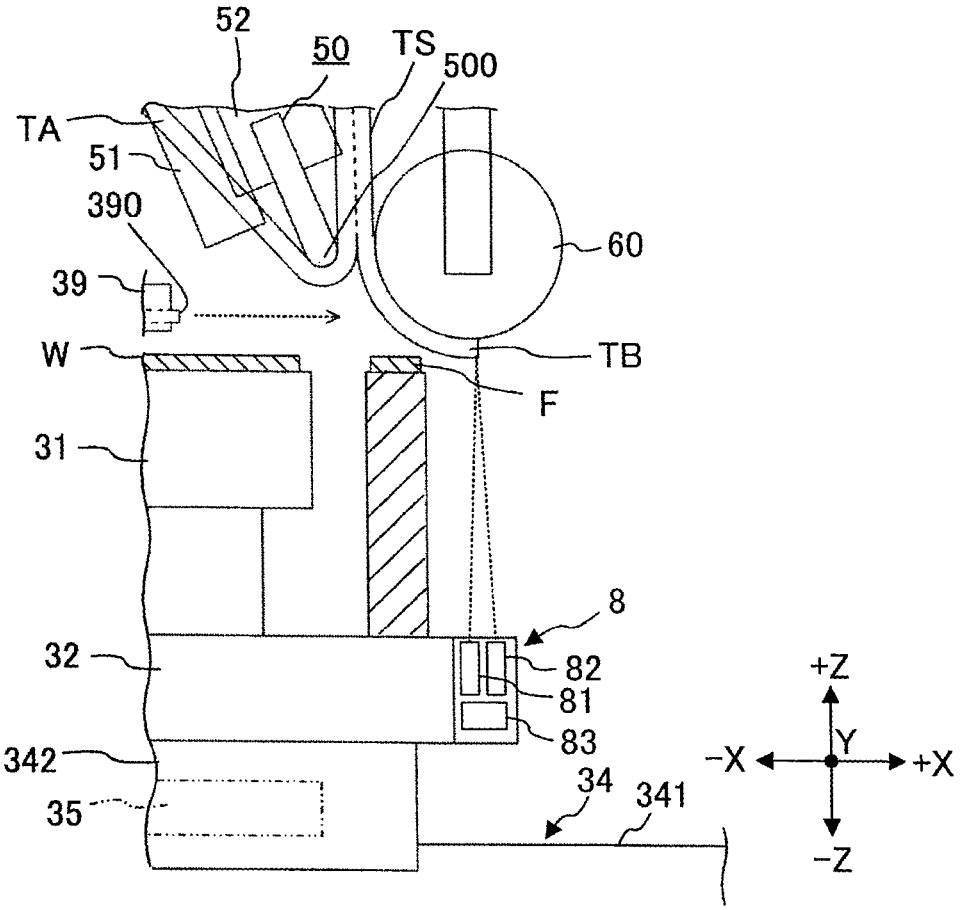
FIG. 3 is a cross-sectional view depicting, on an enlarged scale, an end detecting unit and the like of the tape affixing apparatus according to the first embodiment.

FIG. 2 is a schematic cross-sectional view depicting an example of a configuration of a tape affixing apparatus 1 according to a first embodiment. FIG. 3 is a cross-sectional view depicting, on an enlarged scale, an end detecting unit 8 and the like of the tape affixing apparatus 1.

The tape affixing apparatus 1 depicted in FIG. 2 is an apparatus that uses the tape set TS including the dicing tapes TB (an example of a tape) having the adhesive layer TEB on one surfaces thereof and cut into a shape (circular shape) corresponding to an affixation target object (the ring frame F and a wafer W) and the band-shaped sheet TA affixed to the adhesive layer TEB, and affixes a dicing tape TB to the affixation target object while peeling off the dicing tape TB from the sheet TA. That is, the tape affixing apparatus 1 integrates the ring frame F and the wafer W as an example of the affixation target object by the dicing tape TB depicted in FIG. 1.

The tape affixing apparatus 1 includes a holding unit 3, an affixing unit, and a holding unit moving unit (horizontal moving mechanism) 34.

The holding unit 3 includes a ring frame holding unit 30 that holds the ring frame F, and a wafer holding unit 31 that holds the wafer W within an opening of the ring frame F. The holding unit 3 thereby holds the ring frame F and the wafer W.

The ring frame holding unit 30 depicted in FIG. 2 is a tubular part having an annular shape as viewed in plan. The top surface of the ring frame holding unit 30 constitutes a holding surface that is formed by a porous member or the like and which communicates with a suction source not depicted. The wafer holding unit 31 is a cylindrical part that is surrounded by the ring frame holding unit 30 and holds the wafer W within the opening of the ring frame F. The wafer holding unit 31 has a circular shape as viewed in plan. The top surface of the wafer holding unit 31 constitutes a holding surface that is formed by a porous member or the like and which communicates with a suction source not depicted.

The wafer holding unit 31 and the ring frame holding unit 30 are supported by a support base 32 from below. Disposed below the support base 32 is the holding unit moving unit 34 as an example of the horizontal moving mechanism that reciprocates the holding unit 3 in the X-axis direction via the support base 32. The holding unit moving unit 34 includes a base 341 extending in the X-axis direction, a moving base 342 movable in the X-axis direction along the base 341, and a ball screw mechanism not depicted or the like that moves the moving base 342. The holding unit moving unit 34 moves the holding unit 3 and the affixing unit relative to each other in a horizontal direction.

The support base 32 and the moving base 342 are, for example, connected to each other via a holding unit raising and lowering unit 35 formed by a cylinder mechanism or the like. The holding unit raising and lowering unit 35 raises and lowers the holding unit 3 in the Z-axis direction via the support base 32.

Incidentally, while both of the holding unit 3 and an affixing roller 60 to be described later can be reciprocated in the Z-axis direction in the present embodiment, only one of the holding unit 3 and the affixing roller 60 may be configured to be capable of being reciprocated in the Z-axis direction.

A slide mechanism 71 that can reciprocate a tape set receiving unit 76 in the X-axis direction is disposed above a movement path of the holding unit 3. The slide mechanism 71 includes a base 710 extending in the X-axis direction, a slider 711 to which the tape set receiving unit 76 is fixed and which can slidingly move in the X-axis direction on the base 710, and a ball screw mechanism not depicted that moves the slider 711.

The tape set receiving unit 76 includes a supporting member 761 and a tape set gripping unit 762 such as clamps arranged at an upper end of the supporting member 761. The tape set gripping unit 762 can take over and grip both ends in the Y-axis direction of an end portion of the tape set TS sandwiched by a tape set sandwiching unit 174 of a tape set transferring unit 17.

A discarding unit 73 that discards the sheet TA is disposed on an end side on a −X direction side of the base 710 of the slide mechanism 71. The discarding unit 73 includes a winding unit 731 that grips both ends in the Y-axis direction of an end portion of the sheet TA by a gripping unit 7310, and winds the sheet TA into a roll shape around the outer circumferential surface of the winding unit 731, a motor not depicted that rotates the winding unit 731, and a discarding box 732 that is disposed below the winding unit 731 and into which the sheet TA is dropped when the gripping unit 7310 releases the sheet TA rolled in a roll shape.

The affixing unit affixes a dicing tape TB peeled off from the sheet TA to the ring frame F and the wafer W held by the holding unit 3.

The affixing unit includes a feeding unit 2, a winding unit 4, a peeling plate 50, the affixing roller 60, an air nozzle 39, and the end detecting unit 8.

The feeding unit 2 is an example of a first roller set that sandwiches the tape set TS by at least two rollers. The feeding unit 2 includes a driving roller 21, two driven rollers 22 opposed to each other in the Z-axis direction, and a moving mechanism 23. The driving roller 21 and the two driven rollers 22 rotate in a state of sandwiching the tape set TS to feed the tape set TS.

The moving mechanism 23 includes a guide rail 231 extending in the X-axis direction and a moving unit 232 movable in the X-axis direction on the guide rail 231. The moving mechanism 23 makes the driving roller 21 and the driven rollers 22 approach or separate relative to each other. The moving unit 232 having substantially a U-shape as viewed from the side support the two driven rollers 22 at respective distal ends thereof. The moving unit 232 moves along the guide rail 231. The driving roller 21 and the two driven rollers 22 can be thereby made to approach or separate relative to each other in the X-axis direction.

The winding unit 4 is disposed on a movement path in the X-axis direction of the tape set receiving unit 76. The winding unit 4 has a substantially similar configuration to that of the feeding unit 2. Specifically, the winding unit 4 includes at least a driving roller 41, two driven rollers 42 opposed to each other in the X-axis direction, and a moving mechanism 43 that makes the driving roller 41 and the driven rollers 42 approach or separate relative to each other. The winding unit 4 is an example of a second roller set that sandwiches the sheet TA by at least two rollers. The driving roller 41 and the two driven rollers 42 wind the sheet TA by rotating in a state of sandwiching the sheet TA from which the dicing tape TB is peeled off.

The moving mechanism 43 includes a guide rail 431 extending in the Z-axis direction and a moving unit 432 movable in the Z-axis direction on the guide rail 431. The moving unit 432 supports the two driven rollers 42 at respective upper ends thereof. The moving unit 432 moves along the guide rail 431. The driving roller 41 and the driven rollers 42 can be thereby made to approach or separate relative to each other in the Z-axis direction.

The peeling plate 50 peels off a dicing tape TB from the sheet TA by bending the tape set TS at an acute angle at a position between the feeding unit 2 and the winding unit 4. For example, the peeling plate 50 extends in the Y-axis direction with a length equal to or more than the width (Y-axis direction length) of the tape set TS, and is disposed via a movable member 52 on a base 51 extending toward the affixing roller 60 from obliquely above. A distal end portion 500 on a lower end side of the peeling plate 50 is, for example, rounded in an R-shape. The movable member 52 can reciprocate on the base 51. When the movable member 52 is moved to a lower end side of the base 51, the peeling plate 50 presses the sheet TA of the tape set TS and bends the sheet TA at an acute angle. The dicing tape TB can be thereby peeled off from the sheet TA.

The base 51 is, for example, rotatable about an axis in the Y-axis direction. An angle of the peeling plate 50 with respect to the affixing roller 60 can be varied by rotating the base 51 by a predetermined angle.

The affixing roller 60 affixes the dicing tape TB to the ring frame F and the wafer W by pressing the dicing tape TB peeled off from the sheet TA by the peeling plate 50 against the ring frame F and the wafer W. The affixing roller 60 is rotatable about an axis in the Y-axis direction. The affixing roller 60 is disposed above the holding unit 3 and extends in the Y-axis direction with a length at least equal to or more than the diameter of the dicing tape TB. An affixing roller positioning unit 61 formed by, for example, a cylinder mechanism or the like is connected to the affixing roller 60. The affixing roller positioning unit 61 can raise and lower the affixing roller 60 in the Z-axis direction in which the affixing roller 60 approaches or separates from the holding unit 3.

The air nozzle 39 makes a distal end of the dicing tape TB peeled off from the sheet TA conform to the outside surface of the affixing roller 60. For example, the air nozzle 39 is disposed above the wafer holding unit 31, and blows air so as to make the dicing tape TB peeled off from the sheet TA conform to the affixing roller 60. The air nozzle 39 has a jetting port 390 facing a +X direction side. The air nozzle 39 communicates with an air supply source 393 formed by a compressor or the like.

The end detecting unit 8 is, for example, disposed directly below the affixing roller 60. The end detecting unit 8 detects the distal end of the dicing tape TB made to conform to the outside surface of the affixing roller 60. The end detecting unit 8 is disposed at an end in a moving direction (+X direction) of the support base 32 at a time of affixation of the dicing tape TB. At least a light emitting unit 81 of the end detecting unit 8 is preferably disposed in the holding unit 3, and is more preferably disposed at an end in a moving direction (+X direction) of the holding unit 3 (support base 32). The end detecting unit 8 in the present first embodiment includes the light emitting unit 81 that emits measurement light toward the affixing roller 60, a light receiving unit 82 that receives reflected light of the measurement light, and a detecting unit 83 that detects the distal end of the dicing tape TB on the basis of light reception of the reflected light (for example, an amount of light received) by the light receiving unit 82.

Incidentally, information indicating that the distal end of the dicing tape TB is detected by the detecting unit 83 is sent as a signal to a controller 100 to be described later by wire or wireless. Then, on the basis of the detection of the distal end of the dicing tape TB, the controller 100 controls various parts of the tape affixing apparatus 1 so as to affix the dicing tape TB to the ring frame F and the wafer W.

The tape affixing apparatus 1, for example, includes a first tape set supporting unit 11 and a second tape set supporting unit 12 that support tape sets TS wound in a roll shape. The first tape set supporting unit 11 and the second tape set supporting unit 12 have similar configurations. Therefore, in the following, the configuration of the first tape set supporting unit 11 will be described.

The first tape set supporting unit 11 has a case 110 that houses the tape set TS. An opening 112 for passing the tape set TS therethrough is formed in a bottom wall of the case 110. An end detecting unit 111 that detects an end of the tape set TS, the end detecting unit 111 being formed by an optical sensor or the like, is disposed at an end portion of the opening 112.

A supporting cylinder 113 set inside a roll tube TC wound with the tape set TS is disposed within the case 110. The supporting cylinder 113 is rotatable about an axis in the Y-axis direction by a rotating unit 114, which is, for example, an actuator such as a motor. Incidentally, an openable and closable lid not depicted is disposed on a near side (near side of a paper plane in the Y-axis direction) of the case 110.

A pair of guide rollers 14 is disposed directly below the opening 112 of the case 110 of each of the first tape set supporting unit 11 and the second tape set supporting unit 12. The pair of guide rollers 14 guides the tape set TS extracted from the case 110 toward the tape set transferring unit 17. Incidentally, in the illustrated example, a guide roller 15 that guides the tape set TS toward the feeding unit 2 is disposed in the vicinity of the guide rollers 14 on the second tape set supporting unit 12 side.

The tape set transferring unit 17 includes a rotating mechanism 172 connected to a lower end of a supporting member 171, an arm portion 173 connected to the rotating mechanism 172, a tape set sandwiching unit 174 disposed on a distal end of the arm portion 173, the tape set sandwiching unit 174 being formed by clamps or the like, and a slide mechanism 175 that slidingly moves the supporting member 171 in the X-axis direction. The tape set sandwiching unit 174 can sandwich both ends in the Y-axis direction of the end portion of the tape set TS.

The rotating mechanism 172 includes a roller rotatable in a clockwise direction or a counterclockwise direction as viewed from the Y-axis direction. The rotating mechanism 172 can position the tape set sandwiching unit 174 at a first sandwiching position PA at which the tape set sandwiching unit 174 can sandwich the tape set TS extracted from the first tape set supporting unit 11, a second sandwiching position PB at which the tape set TS extracted from the second tape set supporting unit 12 is sandwiched, and a releasing position PC at which the tape set sandwiching unit 174 releases the tape set TS after the tape set TS is sandwiched by the feeding unit 2.

The slide mechanism 175 includes a base 1751 extending in the X-axis direction, a slider 1752 capable of sliding movement in the X-axis direction on the base 1751, and a ball screw mechanism not depicted that moves the slider 1752. A sliding movement of the slider 1752 in the X-axis direction on the base 1751 can slidingly move the tape set sandwiching unit 174 in the X-axis direction together with the rotating mechanism 172.

A transporting unit 9 is disposed so as to be capable of being raised and lowered and moved horizontally. The transporting unit 9 has a transporting pad 90 on a bottom surface thereof. The dicing tape TB to be described later is affixed to the transporting pad 90. The transporting pad 90 thereby holds the ring frame F and the wafer W that have become integral with each other.

The controller 100 includes a processor (for example, a central processing unit (CPU)) functioning as an arithmetic processing apparatus that controls the operation of various parts of the tape affixing apparatus, and memories such as a read only memory (ROM) as a read-only semiconductor memory in which predetermined control programs are recorded in advance, a random access memory (RAM) as a semiconductor memory capable of being written and read as needed, the random access memory being used as a storage area for work as required when the processor executes various kinds of control programs, and the like.

An example of operation of the tape affixing apparatus 1 will be described in the following. First, a wafer W is mounted on the wafer holding unit 31 of the holding unit 3 such that centers thereof are substantially aligned with each other, and a ring frame F is mounted on the ring frame holding unit 30. Next, the suction sources not depicted are actuated to suck and hold the wafer W by the holding surface of the wafer holding unit 31 and suck and hold the ring frame F by the holding surface of the ring frame holding unit 30.

The tape set transferring unit 17, for example, selects the first tape set supporting unit 11, and extracts the tape set TS from the first tape set supporting unit 11. Specifically, while the rotating unit 114 rotates the tape set TS in a roll shape within the first tape set supporting unit 11 in a normal rotation direction (for example, a clockwise direction as viewed from the front of the paper plane), the tape set TS set in a band-shaped is passed through the opening 112 and between the pair of guide rollers 14, and is fed downward by the pair of guide rollers 14. In addition, the rotating mechanism 172 and the slide mechanism 175 position the tape set sandwiching unit 174 at the first sandwiching position PA. The tape set sandwiching unit 174 sandwiches both ends in the Y-axis direction of the end portion of the tape set TS fed by the pair of guide rollers 14.

The slide mechanism 175 moves the tape set sandwiching unit 174 holding the tape set TS in the +X direction. Accordingly, the tape set TS is further extracted from the first tape set supporting unit 11. When the rotating mechanism 172 rotates in the clockwise direction, for example, the tape set TS sandwiched by the tape set sandwiching unit 174 is hung on the guide roller 15, and is passed between the driving roller 21 and the driven rollers 22 of the feeding unit 2 and hung on the driving roller 21. The tape set sandwiching unit 174 is moved to the releasing position PC.

Next, the slide mechanism 71 slidingly moves the slider 711 in, for example, the +X direction along the base 710, and thereby moves the tape set gripping unit 762 to the releasing position PC. When the tape set sandwiching unit 174 releases the tape set TS at the releasing position PC, the tape set gripping unit 762 takes over and holds both ends in the Y-axis direction of the end portion of the tape set TS. Further, the slide mechanism 71 moves the tape set gripping unit 762 in a −X direction. The tape set TS gripped by the tape set gripping unit 762 is pulled in the same direction, and is passed between the driving roller 41 and the driven rollers 42 of the winding unit 4. The tape set TS is guided to the winding unit 731 of the discarding unit 73. Then, the gripping unit 7310 of the winding unit 731 holds both ends in the Y-axis direction of the end portion of the tape set TS.

The moving mechanism 23 of the feeding unit 2 makes the two driven rollers 22 approach the driving roller 21, and the driving roller 21 and the two driven rollers 22 sandwich the tape set TS. In addition, the moving mechanism 43 of the winding unit 4 makes the two driven rollers 42 approach the driving roller 41, and the driving roller 41 and the two driven rollers 42 sandwich the tape set TS.

The holding unit moving unit 34 moves the holding unit 3 in the X-axis direction, and thereby the ring frame holding unit 30 holding the ring frame F is positioned directly below the affixing roller 60.

In addition, for example, the holding unit raising and lowering unit 35 moves the holding unit 3 in the Z-axis direction, and thereby the affixing roller 60 is positioned slightly above a stop height position at a time of affixing the dicing tape TB to the ring frame F held by the ring frame holding unit 30.

In addition, the movable member 52 moves to the lower end side of the base 51. The peeling plate 50 is thereby moved so that, for example, the distal end portion 500 is located at a position slightly above a movement path of air to be jetted from the air nozzle 39. Then, as depicted in FIG. 3, the tape set TS passes through a gap between the distal end portion 500 of the peeling plate 50 and the outside surface of the affixing roller 60. Incidentally, this gap is preferably a small gap through which the tape set TS can barely pass. In addition, the distal end portion 500 of the peeling plate 50 contacts and presses the sheet TA of the tape set TS, and thereby bends the tape set TS with the sheet TA on the inside and forms the tape set TS at an acute angle. Then, the dicing tape TB is peeled off from the tape set TS, and the dicing tape TB is fed to below the affixing roller 60.

In this state, compressed air is supplied from the air supply source 393 to the air nozzle 39. Then, the air jetted from the air nozzle 39 is blown onto the dicing tape TB fed to below the affixing roller 60. The dicing tape TB is thereby made to conform to the outside surface of the affixing roller 60.

Then, the distal end of the dicing tape TB is detected by the end detecting unit 8. When the detecting unit 83 of the end detecting unit 8 detects the distal end of the dicing tape TB on the basis of an amount of light received by the light receiving unit 82, the controller 100 starts affixing the dicing tape TB to the ring frame F and the wafer W.

First, in a state in which the dicing tape TB is made to conform to the outside surface of the affixing roller 60 by the air, the affixing roller positioning unit 61 lowers the affixing roller 60 to a stop position at a time of affixation while the affixing roller 60 rotates at a predetermined rotational speed. The dicing tape TB is thereby pressed from one side of the ring frame F held on the ring frame holding unit 30.

The holding unit moving unit 34 sends the ring frame holding unit 30 and the wafer holding unit 31 in the +X direction, and the rotating affixing roller 60 presses the dicing tape TB against the wafer W and the ring frame F. At this time, in the feeding unit 2 depicted in FIG. 2, while the driving roller 21 is rotated at a predetermined rotational speed, the two driven rollers 22 are also rotated as the driving roller 21 is rotated. The feeding unit 2 thereby guides the tape set TS downward toward the holding unit 3. In addition, in the winding unit 4, while the driving roller 41 is rotated at a predetermined rotational speed, the two driven rollers 42 are also rotated as the driving roller 41 is driven. The winding unit 4 thereby guides the sheet TA, from which the dicing tape TB is peeled off by the peeling plate 50, from the peeling plate 50 to the discarding unit 73.

Then, when the holding unit 3 is moved in the +X direction to a predetermined position while the affixing roller 60 presses the dicing tape TB, one piece of dicing tape TB can be affixed to the wafer W and the ring frame F.

Incidentally, as a method for affixing the dicing tape TB to the ring frame F, in a state in which the air blown from the air nozzle 39 makes the dicing tape TB conform to the outside surface of the affixing roller 60, the affixing roller positioning unit 61 may lower the affixing roller 60 toward the ring frame holding unit 30, or the holding unit raising and lowering unit 35 may raise the wafer holding unit 31 and the ring frame holding unit 30 toward the affixing roller 60.

The sheet TA depicted in FIG. 2 from which sheet the dicing tape TB is peeled off is wound by the winding unit 4, and is fed from the winding unit 4 to the winding unit 731 of the discarding unit 73.

The sheet TA is formed into a sheet roll by being wound into a roll shape on the outer circumferential surface of the winding unit 731 rotated by a motor not depicted. After the winding unit 731 forms the sheet roll by winding the sheet TA by a predetermined length, the gripping unit 7310 releases the holding of the sheet roll to discard the sheet roll into the discarding box 732.

The wafer W integrated with the ring frame F via the dicing tape TB is subjected to dicing or the like after being transferred to, for example, a dicing apparatus or the like in a state of being held by the transporting pad 90 of the transporting unit 9. When the operation of affixing the dicing tape TB to one wafer W is thus completed, it is preferable to sequentially transport a new wafer W to the wafer holding unit 31 and transport a ring frame F to the ring frame holding unit 30, and as in the foregoing, repeat the operation of affixing a dicing tape TB and the operation of winding the sheet TA peeled off from the dicing tape TB.

Incidentally, the angle of the tape set TS at a time of the affixation of the dicing tape TB may be made to be a more acute angle by rotating the base 51 in the counterclockwise direction from a +Z direction to the −X direction and thereby tilting the peeling plate 50 toward the horizontal direction by a predetermined angle. When the peeling plate 50 is tilted toward the horizontal direction, the gap between the distal end portion 500 of the peeling plate 50 and the outside surface of the affixing roller 60 can be made to be a very small gap through which the tape set TS passes.

In this state, the air jetted from the air nozzle 39 is blown to the dicing tape TB fed to below the affixing roller 60. The dicing tape TB is thereby made to conform to the outside surface of the affixing roller 60. Thus, the dicing tape TB is affixed to the ring frame F and the wafer W in a state in which the dicing tape TB conforms to the outside surface of the affixing roller 60 so as not to cause a slack in the dicing tape TB. The tension of the affixed dicing tape TB can therefore be made uniform.

In the first embodiment described above, the tape affixing apparatus 1 uses the tape set TS including the dicing tape TB (an example of a tape), the dicing tape TB having the adhesive layer TEB on one surface of the dicing tape TB and being cut in a shape corresponding to the wafer W and the ring frame F as an example of the affixation target object, and the sheet TA in a band shape, the sheet TA being affixed to the adhesive layer TEB, and affixes the dicing tape TB to the wafer W and the ring frame F while peeling off the dicing tape TB from the sheet TA. In addition, the tape affixing apparatus 1 includes the holding unit 3 that holds the wafer W and the ring frame F, the affixing unit that affixes the dicing tape TB peeled off from the sheet TA to the wafer W and the ring frame F held by the holding unit 3, and the holding unit moving unit 34 (an example of a horizontal moving mechanism) that moves the holding unit 3 and the affixing unit relative to each other in the horizontal direction. The affixing unit includes the feeding unit 2 as an example of the first roller set that sandwiches the tape set by at least two rollers, the winding unit 4 as an example of the second roller set that sandwiches the sheet by at least two rollers, the peeling plate 50 that peels off the dicing tape TB from the sheet TA by bending the tape set TS at an acute angle at a position between the feeding unit 2 and the winding unit 4, the affixing roller 60 that affixes the dicing tape TB to the wafer W and the ring frame F by pressing the dicing tape TB peeled off from the sheet TA by the peeling plate 50 against the wafer W and the ring frame F, the air nozzle 39 that makes the distal end of the dicing tape TB peeled off from the sheet TA conform to the outside surface of the affixing roller 60, and the end detecting unit 8 that detects the distal end of the dicing tape TB made to conform to the outside surface of the affixing roller 60.

The end detecting unit 8 thus detects the distal end of the dicing tape TB in a state of being made to conform to the outside surface of the affixing roller 60. Therefore, as compared with, for example, a case where the distal end of the tape set TS before the sheet TA is peeled off from the dicing tape TB is detected by the end detecting unit 111 provided to the opening 112 in the bottom wall of the above-described case 110 depicted in FIG. 2, even when the distal end position of the dicing tape TB made to conform to the outside surface of the affixing roller 60 is displaced due to the occurrence of a slip of the tape set TS or the like on the driving roller 21 and the driven rollers 22 of the feeding unit 2 or the like, the position of the displaced distal end can be detected. It is thereby possible to avoid a positional displacement of an affixation start position of the dicing tape TB. Hence, according to the present first embodiment, it is possible to prevent a positional displacement of an affixation position of the tape (dicing tape TB) with respect to the affixation target object (the wafer W and the ring frame F). Consequently, for example, the center of the dicing tape TB and the center of the ring frame F coincide with each other. It is therefore possible also to avoid re-affixing the dicing tape TB. Hence, as compared with a case where the re-affixation occurs, it is possible to omit a dicing tape TB used for the re-affixation, and omit a time for the re-affixation.

In addition, in the present first embodiment, the end detecting unit 8 includes the light emitting unit 81 that is disposed in the holding unit 3, and emits the measurement light toward the affixing roller 60, the light receiving unit 82 that receives the reflected light of the measurement light, and the detecting unit 83 that detects the distal end of the dicing tape TB on the basis of light reception of the reflected light (for example, an amount of light received) by the light receiving unit 82.

Thus, the distal end of the dicing tape TB can be detected at a position that is separated from the distal end of the dicing tape TB by a distance and does not obstruct the affixation of the dicing tape TB and with a simple configuration that uses the measurement light emitted from the holding unit 3. Incidentally, because at least the light emitting unit 81 is disposed in the holding unit 3, a positional relation (distance) between the light emitting unit 81 (end detecting unit 8) and an end in the moving direction of the holding unit 3 is determined by a design value. Therefore, when the holding unit 3 is moved on the basis of the distance of the design value after the end detecting unit 8 detects the distal end of the dicing tape TB, the distal end of the dicing tape TB can be affixed to a desired position such as an end in the moving direction of the ring frame F. It is thereby possible to prevent the occurrence of a positional displacement of an affixation start position of the dicing tape TB. In addition, as compared with a mode in which the light emitting unit 81 (end detecting unit 8) is disposed at a position other than in the holding unit 3, the end detecting unit 8 can be disposed below the affixing roller 60, and the distal end of the dicing tape TB can be detected easily, without the end detecting unit 8 being disposed at a position that avoids the movement path of the holding unit 3.

Incidentally, in the above description, a description has been made of an example in which the detecting unit 83 detects the distal end of the tape (dicing tape TB) on the basis of the amount of received light received by the light receiving unit 82. However, the light receiving unit 82 may receive the reflected light resulting from reflection of the light emitted from the light emitting unit 81 by the distal end of the surface (lower surface) of the tape, and the detecting unit 83 may measure a distance from the end detecting unit 8 to the tape by using a triangulation method on the basis of an optical path from the light emitting unit 81 to the surface of the tape and to the light receiving unit 82. In this case, when the end detecting unit 8 does not detect (measure) the tape, the end detecting unit 8 measures a distance to the outside surface of the affixing roller 60. Hence, it can be determined that the distal end of the tape is detected when the distance (value) measured by the end detecting unit 8 is decreased. Thus, the detecting unit 83 is not limited to detecting the distal end of the tape on the basis of an amount of received light received by the light receiving unit 82, but it suffices for the detecting unit 83 to detect the distal end of the tape on the basis of light reception by the light receiving unit 82. In addition, in the present first embodiment, description has been made of the end detecting unit 8 including the light emitting unit 81, the light receiving unit 82, and the detecting unit 83, as depicted in FIG. 2 and FIG. 3. However, in a similar manner to the end detecting unit 8 illustrated in FIG. 2 and FIG. 3, the end detecting unit 8 may include a vibration generating unit that is disposed in the holding unit 3, and generates an ultrasonic vibration toward the affixing roller 60, a vibration receiving unit 82 that receives a reflected vibration resulting from reflection of the ultrasonic vibration by the affixing roller 60 or the dicing tape TB, and a detecting unit 83 that detects the distal end of the dicing tape TB on the basis of the value of the vibration receiving unit 82. Even in this case, the distal end of the dicing tape TB can be detected at a position that is separated from the distal end of the dicing tape TB by a distance and does not obstruct the affixation of the dicing tape TB and with a simple configuration that uses the ultrasonic vibration generated from the holding unit 3.

Alternatively, the end detecting unit 8 may image the distal end of the dicing tape TB, and detect the distal end of the dicing tape TB on the basis of image processing of an imaged image. In addition, the end detecting unit 8 may use a tactile sensor 181 that comes into contact with the distal end of the dicing tape TB as in an end detecting unit 18 in a second embodiment to be described later or the like. It suffices for the end detecting unit 8 to detect the distal end of the dicing tape TB.

Second Embodiment

Figure 4:
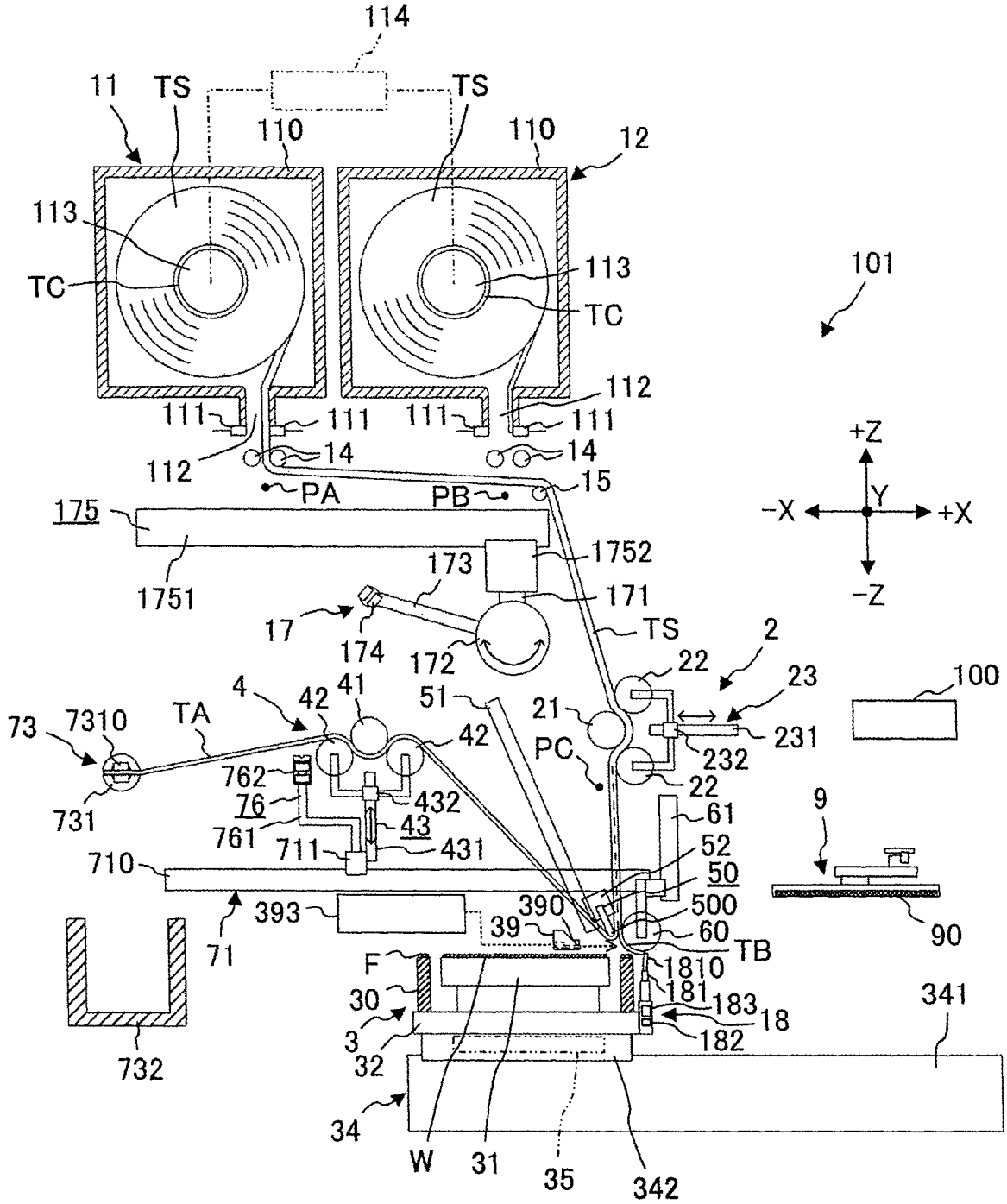
FIG. 4 is a schematic cross-sectional view depicting an example of a configuration of a tape affixing apparatus according to a second embodiment.
Figure 5:
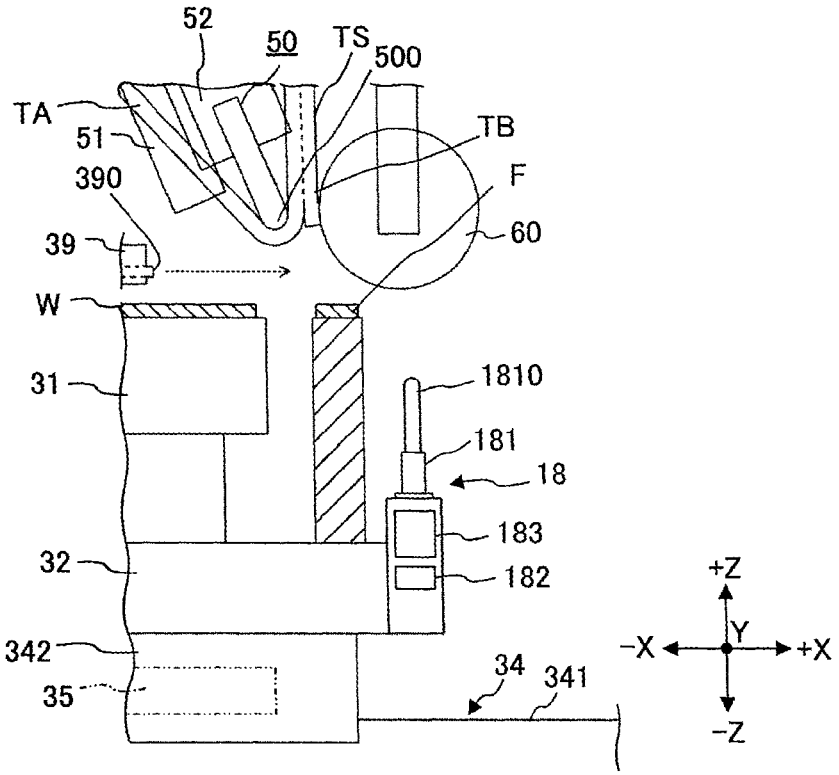
FIG. 5 is a cross-sectional view (1) of assistance in explaining an end detecting unit of the tape affixing apparatus according to the second embodiment.
Figure 6:
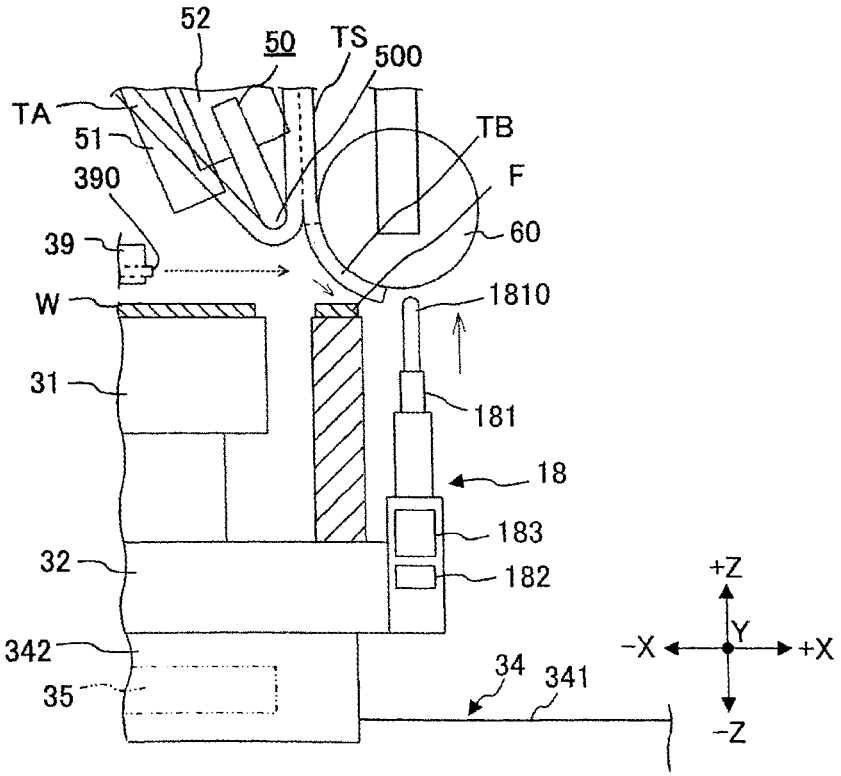
FIG. 6 is a cross-sectional view (2) of assistance in explaining the end detecting unit of the tape affixing apparatus according to the second embodiment.
Figure 7:
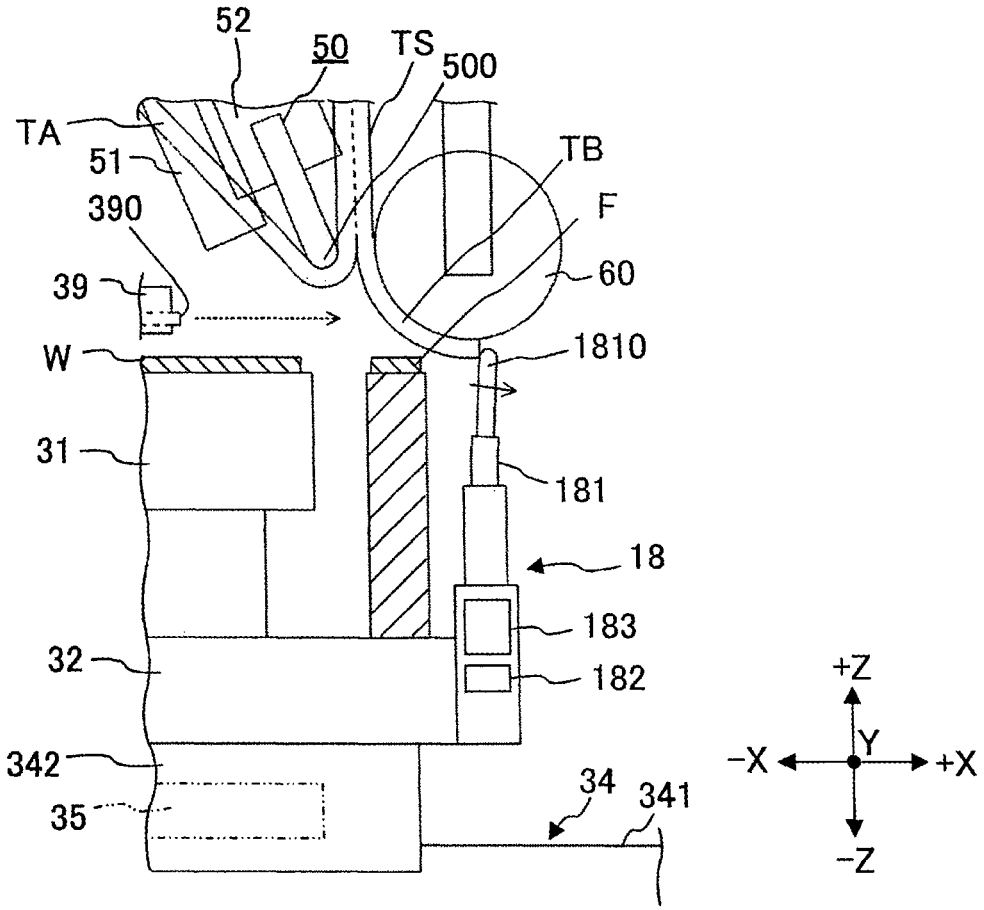
FIG. 7 is a cross-sectional view (3) of assistance in explaining the end detecting unit of the tape affixing apparatus according to the second embodiment.

FIG. 4 is a schematic cross-sectional view depicting an example of a configuration of a tape affixing apparatus 101 according to a second embodiment. FIGS. 5 to 7 are cross-sectional views of assistance in explaining an end detecting unit 18 of the tape affixing apparatus 101.

Incidentally, the tape affixing apparatus 101 according to the present second embodiment can be made similar to the tape affixing apparatus 1 except that the end detecting unit 18 is disposed in the tape affixing apparatus 101 in place of the end detecting unit 8. Therefore, detailed description thereof will be omitted.

The end detecting unit 18 detects the distal end of the dicing tape TB made to conform to the outside surface of the affixing roller 60. The end detecting unit 18 is disposed at an end in the moving direction (+X direction) of the support base 32 at a time of affixation of the dicing tape TB. At least the tactile sensor 181 of the end detecting unit 18 is preferably disposed in the holding unit 3, and is more preferably disposed at an end in the moving direction (+X direction) of the holding unit 3 (support base 32). The end detecting unit 18 in the present second embodiment includes the tactile sensor 181 that is disposed in the holding unit 3, and extends such that a distal end thereof is in contact with the outside surface of the affixing roller 60, and a detecting unit 182 that detects the distal end of the dicing tape TB by the tactile sensor 181. In addition, the end detecting unit 18 includes a raising and lowering unit 183. Incidentally, in the example of FIGS. 4 to 7, the tactile sensor 181 is depicted not being in contact with the outside surface of the affixing roller 60. However, because the dicing tape TB has a small thickness, the tactile sensor 181 is preferably in contact with the outside surface of the affixing roller 60.

As depicted in FIG. 5, the tactile sensor 181 is disposed so as to project upward from the support base 32 of the holding unit 3, and a contact part 1810 as an upper portion of the tactile sensor 181 comes into contact with the distal end of the dicing tape TB. When the contact part 1810 comes into contact with the distal end of the dicing tape TB, the tactile sensor 181 is pressed and inclined by the distal end of the dicing tape TB, as depicted in FIG. 7. It is to be noted that the tactile sensor 181 does not have to be pressed and inclined by the distal end of the dicing tape TB, but the tactile sensor 181 may be a tactile sensor that is pressed and moved in one direction (+X direction) by the distal end of the dicing tape TB, a tactile sensor that detects a contact pressure with the distal end of the dicing tape TB, or the like.

The detecting unit 182 detects the distal end of the dicing tape TB on the basis of the inclination of the tactile sensor 181. It is to be noted that it suffices for the detecting unit 182 to detect the distal end of the dicing tape TB by the tactile sensor 181, and that the detecting unit 182 is therefore not limited to detecting the distal end of the dicing tape TB on the basis of the inclination of the tactile sensor 181.

As depicted in FIG. 5 and FIG. 6, the raising and lowering unit 183 is an actuator such, for example, as a motor or the like that raises and lowers the tactile sensor 181. It is preferable that the raising and lowering unit 183 raise the tactile sensor 181 as depicted in FIG. 6 when the distal end of the dicing tape TB is to be detected, and that the raising and lowering unit 183 lower the tactile sensor 181 as depicted in FIG. 5 so as not to obstruct the operation of affixing the dicing tape TB after the distal end of the dicing tape TB is detected.

Incidentally, information indicating that the distal end of the dicing tape TB is detected by the detecting unit 182 is sent as a signal to the controller 100 by wire or wireless. Then, also in the present second embodiment, on the basis of the detection of the distal end of the dicing tape TB, the controller 100 controls various parts of the tape affixing apparatus 101 so as to affix the dicing tape TB to the ring frame F and the wafer W.

The second embodiment described above can also provide similar effects to those of the foregoing first embodiment with regard to a configuration similar to that of the foregoing first embodiment, specifically effects of being able to prevent a positional displacement of the affixation position of the tape (dicing tape TB) with respect to the affixation target object (the wafer W and the ring frame F) and the like.

In addition, in the present second embodiment, the end detecting unit 18 includes the tactile sensor 181 that is disposed in the holding unit 3, and extends such that the distal end thereof is in contact with the outside surface of the affixing roller 60, and the detecting unit 182 that detects the distal end of the dicing tape TB by the tactile sensor 181.

Thus, because the tactile sensor 181 comes into direct contact with the distal end of the dicing tape TB, the distal end of the dicing tape TB can be detected reliably. In addition, in a case where a sensor moving unit such as the raising and lowering unit 183 that raises and lowers the tactile sensor 181 is arranged, the tactile sensor 181 can be moved (retracted) to a position that is separated from the affixing roller 60 by a distance and does not obstruct the affixation of the dicing tape TB when the distal end of the dicing tape TB is not detected. In addition, because at least the tactile sensor 181 is disposed in the holding unit 3, a positional relation (distance) between the tactile sensor 181 (end detecting unit 18) and an end in the moving direction of the holding unit 3 is determined by a design value. Therefore, when the holding unit 3 is moved on the basis of the distance of the design value after the end detecting unit 18 detects the distal end of the dicing tape TB, the distal end of the dicing tape TB can be affixed to a desired position such as an end in the moving direction of the ring frame F. It is thereby possible to prevent the occurrence of a positional displacement of an affixation start position of the dicing tape TB. In addition, as compared with a mode in which the tactile sensor 181 (end detecting unit 18) is disposed at a position other than in the holding unit 3, the end detecting unit 18 can be disposed below the affixing roller 60, and the distal end of the dicing tape TB can be detected easily, without the end detecting unit 18 being disposed at a position that avoids the movement path of the holding unit 3.

It is to be noted that while each embodiment of the present invention has been described, overall or partial combinations of the foregoing first and second embodiments and modifications thereof may be adopted as other embodiments of the present invention.

In addition, embodiments of the present invention are not limited to the foregoing first and second embodiments and the modifications thereof, but may be changed, replaced, and modified in various manners without departing from the spirit of the technical concept of the present invention. Further, when the technical concept of the present invention can be implemented by a different method based on the progress of a technology or another technology derived therefrom, the technical concept of the present invention may be carried out by using the method. Hence, claims cover all embodiments that can be included within the scope of the technical concept of the present invention.

As described above, the tape affixing apparatus according to the present invention detects the distal end of the tape made to conform to the outside surface of the affixing roller, and can therefore prevent a positional displacement of an affixation position of the tape with respect to the affixation target object. Thus, the tape affixing apparatus according to the present invention is useful particularly in a case where the affixation target object is a wafer and a ring frame, and the tape is a dicing tape, and the like.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A tape affixing apparatus for using a tape set including a tape, the tape having an adhesive layer on one surface of the tape and being cut in a shape corresponding to an affixation target object, and a band-shaped sheet affixed to the adhesive layer, and affixing the tape to the affixation target object while peeling off the tape from the sheet, the tape affixing apparatus comprising:

a holding unit configured to hold the affixation target object;

an affixing unit configured to affix the tape peeled off from the sheet to the affixation target object held by the holding unit; and a horizontal moving mechanism configured to move the holding unit and the affixing unit relative to each other in a horizontal direction, the affixing unit including:

a first roller set configured to sandwich the tape set by at least two rollers, a second roller set configured to sandwich the sheet by at least two rollers, a peeling plate configured to peel off the tape from the sheet by bending the tape set at an acute angle at a position between the first roller set and the second roller set, an affixing roller configured to affix the tape to the affixation target object by pressing the tape peeled off from the sheet by the peeling plate against the affixation target object, an air nozzle configured to make a distal end of the tape peeled off from the sheet conform to an outside surface of the affixing roller, and an end detecting unit configured to detect the distal end of the tape made to conform to the outside surface of the affixing roller, wherein the end detecting unit faces the affixing roller to thereby detect whether the distal end of the tape conforms with the outside surface of the fixing roller.

2. The tape affixing apparatus according to claim 1, wherein:

the end detecting unit includes a light emitting unit disposed in the holding unit and configured to emit measurement light toward the affixing roller, a light receiving unit configured to receive reflected light of the measurement light, and a detecting unit configured to detect the distal end of the tape on a basis of light reception of the reflected light by the light receiving unit.

3. The tape affixing apparatus according to claim 1, wherein:

the end detecting unit includes a tactile sensor disposed in the holding unit and configured to extend such that a distal end of the tactile sensor is in contact with the outside surface of the affixing roller and a detecting unit configured to detect the distal end of the tape by the tactile sensor.

4. The tape affixing apparatus according to claim 1, wherein:

the end detecting unit includes an ultrasonic vibration generating unit disposed in the holding unit and configured to generate an ultrasonic vibration toward the affixing roller, a vibration receiving unit configured to receive a reflected vibration resulting from reflection of the ultrasonic vibration by the affixing roller or the tape, and a detecting unit configured to detect the distal end of the tape on a basis of a value of the vibration receiving unit.

5. The tape affixing apparatus according to claim 1, wherein the end detecting unit is disposed below the affixing roller.

6. The tape affixing apparatus according to claim 1, wherein the end detecting unit is disposed on a support base that is configured and arranged to move with the holding unit.

7. A tape affixing apparatus for using a tape set including a tape, the tape having an adhesive layer on one surface of the tape and being cut in a shape corresponding to an affixation target object, and a band-shaped sheet affixed to the adhesive layer, and affixing the tape to the affixation target object while peeling off the tape from the sheet, the tape affixing apparatus comprising:

a holding unit configured to hold the affixation target object;

an affixing unit configured to affix the tape peeled off from the sheet to the affixation target object held by the holding unit; and a horizontal moving mechanism configured to move the holding unit and the affixing unit relative to each other in a horizontal direction, the affixing unit including a first roller set configured to sandwich the tape set by at least two rollers, a second roller set configured to sandwich the sheet by at least two rollers, a peeling plate configured to peel off the tape from the sheet by bending the tape set at an acute angle at a position between the first roller set and the second roller set, an affixing roller configured to affix the tape to the affixation target object by pressing the tape peeled off from the sheet by the peeling plate against the affixation target object, an air nozzle configured to make a distal end of the tape peeled off from the sheet conform to an outside surface of the affixing roller, and an end detecting unit including a vibration generating unit disposed in the holding unit, the vibration generating unit configured to generate an ultrasonic vibration directed toward the affixing roller, the end detecting unit configured to detect the distal end of the tape made to conform to the outside surface of the affixing roller by analyzing the ultrasonic vibration generated by the vibration generating unit.

8. The tape affixing apparatus according to claim 7, wherein the end detecting unit further includes a vibration receiving unit configured to receive a reflected vibration resulting from reflection of the ultrasonic vibration by the affixing roller or the tape, and a detecting unit configured to detect the distal end of the tape on a basis of a value of the vibration receiving unit, corresponding to the analysis of the ultrasonic vibration generated by the vibration unit.

* * * * *